US010746048B2

(12) United States Patent
Lefebvre et al.

(10) Patent No.: US 10,746,048 B2
(45) Date of Patent: Aug. 18, 2020

(54) ANNULAR RING ASSEMBLY FOR SHROUD COOLING

(71) Applicant: Pratt & Whitney Canada Corp., Longueuil (CA)

(72) Inventors: Guy Lefebvre, St. Bruno de Montarville (CA); René Paquet, Montreal (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 284 days.

(21) Appl. No.: 15/608,577

(22) Filed: May 30, 2017

(65) Prior Publication Data

US 2017/0314414 A1 Nov. 2, 2017

Related U.S. Application Data

(63) Continuation of application No. 14/335,289, filed on Jul. 18, 2014, now Pat. No. 9,689,276.

(51) Int. Cl.
*F01D 25/12* (2006.01)
*F01D 25/14* (2006.01)
(Continued)

(52) U.S. Cl.
CPC ..... *F01D 25/12* (2013.01); *F01D 11/24* (2013.01); *F01D 25/14* (2013.01); *F01D 25/246* (2013.01);
(Continued)

(58) Field of Classification Search
CPC .... F01D 25/12; F01D 25/14; F05D 2260/201; F28F 3/12; F28F 3/14
See application file for complete search history.

(56) References Cited

U.S. PATENT DOCUMENTS 4,056,332 A * 11/1977 Meloni ..... F01D 5/188 416/97 A
4,526,226 A * 7/1985 Hsia ..... F01D 5/187 165/109.1
(Continued)

FOREIGN PATENT DOCUMENTS

WO 2014186166 A1 11/2014

*Primary Examiner* — Michael Lebentritt
*Assistant Examiner* — Topaz L. Elliot
(74) *Attorney, Agent, or Firm* — Norton Rose Fulbright Canada LLP

(57) ABSTRACT

A gas turbine engine includes an annular casing and a plurality of shroud segments forming an annular shroud. The annular shroud forms with the annular casing an annular cavity therebetween. The annular cavity includes an inlet and an outlet. An annular ring assembly is disposed in the annular cavity between the casing and the shroud and cooperating therewith to provide a first annular chamber and a second annular chamber. The annular ring assembly and a first portion of the shroud form the first annular chamber. The annular ring assembly and a second portion of the shroud form the second annular chamber. The annular ring assembly forms an intermediate annular chamber disposed between the first annular chamber and the second annular chamber. A flow path for coolant air is sequentially defined through the inlet, the first annular chamber, the intermediate annular chamber, the second annular chamber and the outlet.

20 Claims, 4 Drawing Sheets

(51) Int. Cl.
*F01D 11/24* (2006.01)
*F01D 25/24* (2006.01)

(52) U.S. Cl.
CPC .... *F05D 2240/11* (2013.01); *F05D 2260/201* (2013.01); *F05D 2260/205* (2013.01)

(56) References Cited

U.S. PATENT DOCUMENTS

| | | | | |
|---|---|---|---|---|
| 4,573,865 | A | 3/1986 | Hsia et al. | |
| 6,139,257 | A | 10/2000 | Proctor | |
| 6,779,597 | B2 | 8/2004 | Demarche et al. | |
| 7,097,418 | B2 | 8/2006 | Trindade | |
| 8,118,547 | B1 | 2/2012 | Liang | |
| 8,240,980 | B1 | 8/2012 | Liang | |
| 8,246,299 | B2 * | 8/2012 | Razzell | F01D 11/005 415/173.1 |
| 8,276,391 | B2 * | 10/2012 | Berry | F23R 3/002 60/782 |
| 8,414,255 | B2 * | 4/2013 | Ireland | F01D 5/187 415/116 |
| 8,439,636 | B1 | 5/2013 | Liang | |
| 8,814,507 | B1 | 8/2014 | Campbell | |
| 9,080,458 | B2 | 7/2015 | Romanov | |
| 9,404,379 | B2 | 8/2016 | Mishra | |
| 9,638,047 | B1 * | 5/2017 | Jones | F01D 5/188 |
| 9,657,642 | B2 * | 5/2017 | Kanjiyani | F01D 5/187 |
| 2011/0064567 | A1 | 3/2011 | Friis | |
| 2013/0051972 | A1 | 2/2013 | Romanov | |
| 2016/0040553 | A1 | 2/2016 | Headland | |

* cited by examiner

ANNULAR RING ASSEMBLY FOR SHROUD COOLING

TECHNICAL FIELD

The application relates generally to rotors and stators in a gas turbine engine and, more particularly, to cooling of such rotors and stators.

BACKGROUND OF THE ART

Rotors and stators present in gas turbine engines may be subjected to high temperatures which may induce, stresses and early damages. Shrouds of these rotors and/or stators may be cooled so as to delay or prevent side effects associated with the high temperatures. The cooling may, however, leave some portions of the rotor and/or stator insufficiently cooled.

SUMMARY

In one aspect, there is provided a gas turbine engine comprising: an annular shroud encircling one of a stator and a rotor, the shroud having a first portion and a second portion axially disposed relative to a rotation axis of the engine and a direction of airflow through the rotor in use; an annular casing outwardly spaced-apart from the shroud relative to the rotation axis and mounted to the shroud to define an annular cavity between the casing and the shroud, the cavity including an inlet communicating with a source of coolant air and an outlet communicating with gas path; an annular ring assembly disposed in the cavity between the casing and the shroud and configured to cooperate with the casing and the shroud, the ring assembly and a first portion of the shroud forming a first annular chamber, the annular ring assembly and a second portion of the shroud forming a second annular chamber, the ring forming an intermediate annular chamber disposed between the first annular chamber and the second annular chamber, the annular ring assembly having: a non-diffusive wall preventing coolant incoming from the inlet to reach the second portion of the shroud and directing the coolant toward the first annular chamber; an annular impingement body having: a first surface facing the shroud; and an opposed second surface facing the casing; and an annular dividing body connected to the second surface of the impingement body and forming therewith the intermediate annular chamber, the annular ring assembly having a plurality of first impingement apertures for distributing coolant from the inlet to the first portion of the shroud and a plurality of second impingement apertures for distributing coolant from the intermediate annular chamber to the second portion of the shroud, the first chamber communicating with the intermediate annular chamber via at least one intermediate aperture disposed between the plurality of first impingement apertures and the plurality of second impingement apertures, the annular ring assembly thus providing a coolant flow path sequentially from the inlet, through the first annular chamber, the intermediate annular chamber, the second annular chamber and the outlet.

In another aspect, there is provided a gas turbine engine comprising: an annular casing; a plurality of shroud segments forming an annular shroud, each shroud segment defining an angular portion of the annular shroud, the annular shroud forming with the annular casing an annular cavity therebetween, the annular cavity including an inlet and an outlet; an annular ring assembly disposed in the annular cavity between the casing and the shroud and cooperating therewith to provide a first annular chamber and a second annular chamber, the annular ring assembly and a first portion of the shroud forming the first annular chamber, the annular ring assembly and a second portion of the shroud forming the second annular chamber, the annular ring assembly forming an intermediate annular chamber disposed between the first annular chamber and the second annular chamber, a flow path for coolant air being sequentially defined through the inlet, the first annular chamber, the intermediate annular chamber, the second annular chamber and the outlet.

DESCRIPTION OF THE DRAWINGS

Reference is now made to the accompanying figures in which.

DETAILED DESCRIPTION

Figure 1:
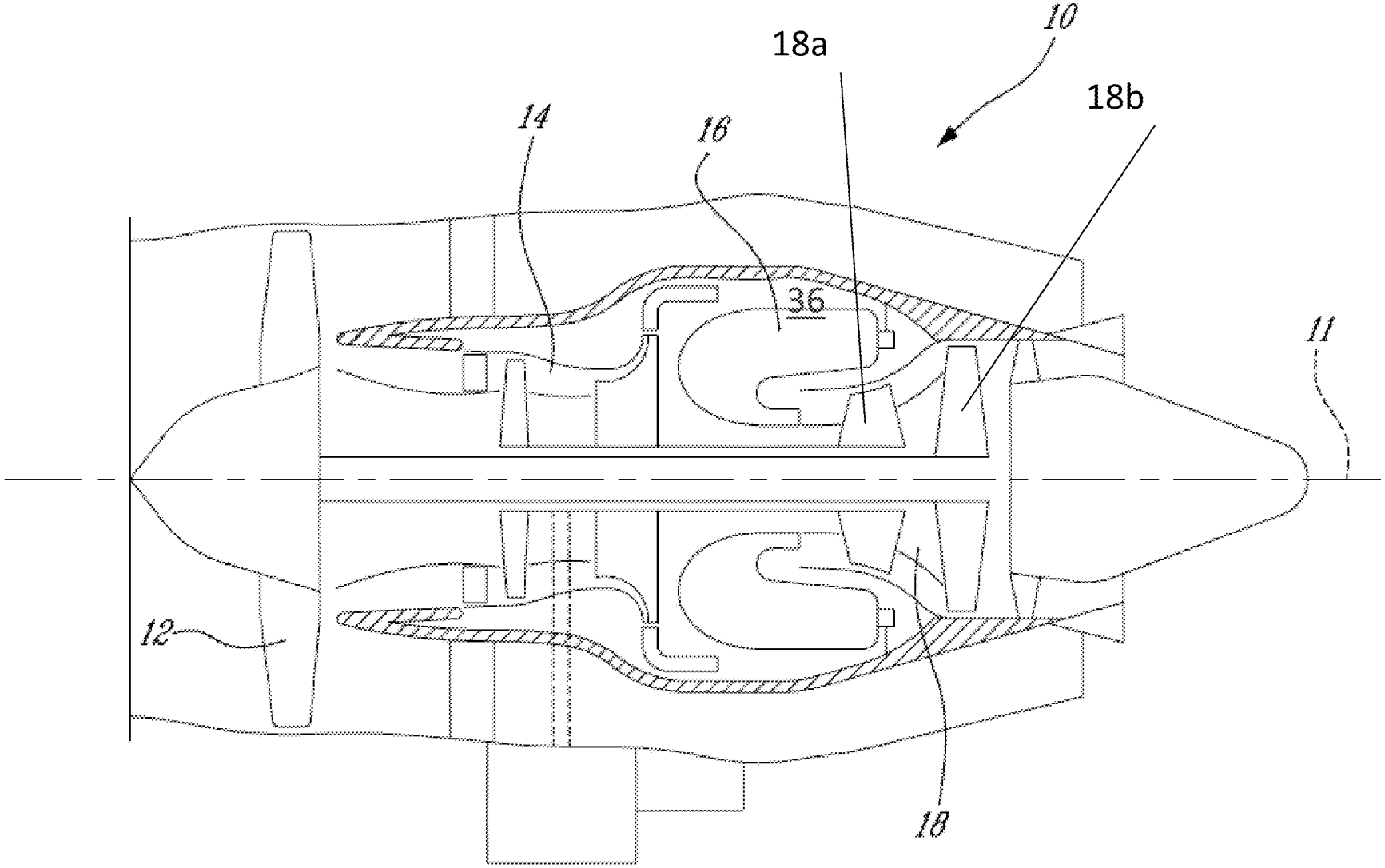
FIG. 1 is a schematic cross-sectional view of a gas turbine engine.

FIG. 1 illustrates a gas turbine engine 10 of a type preferably provided for use in subsonic flight, generally comprising in serial flow communication along a centerline 11: a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The turbine section 18 includes a high pressure turbine 18*a* in contact with hot gases produced by the combustor 16, and a low pressure turbine 18*b* disposed downstream of the high pressure turbine 18*a*.

Figure 2:
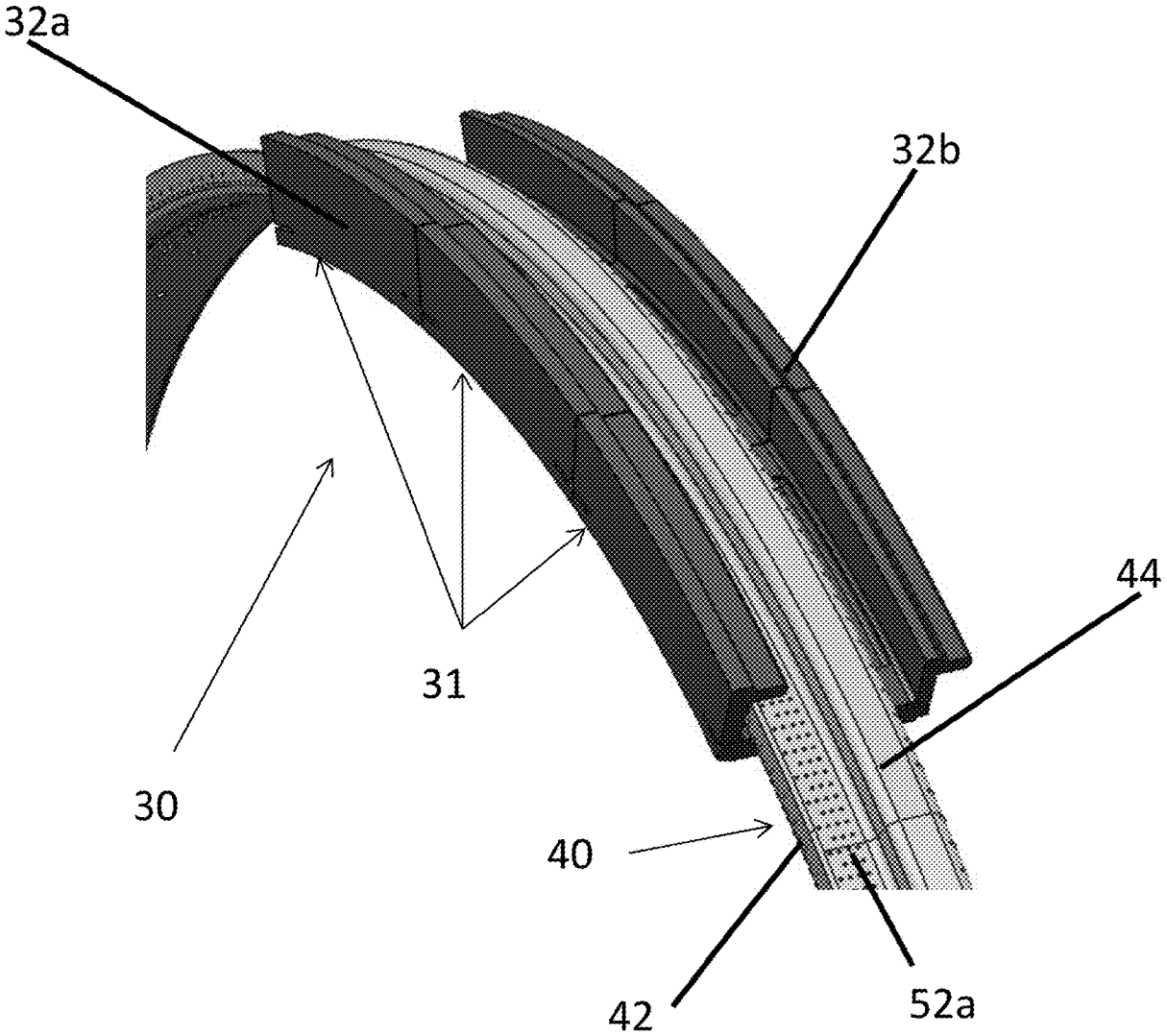
FIG. 2 is a partial perspective view of the shroud and the cooling ring.
Figure 3:
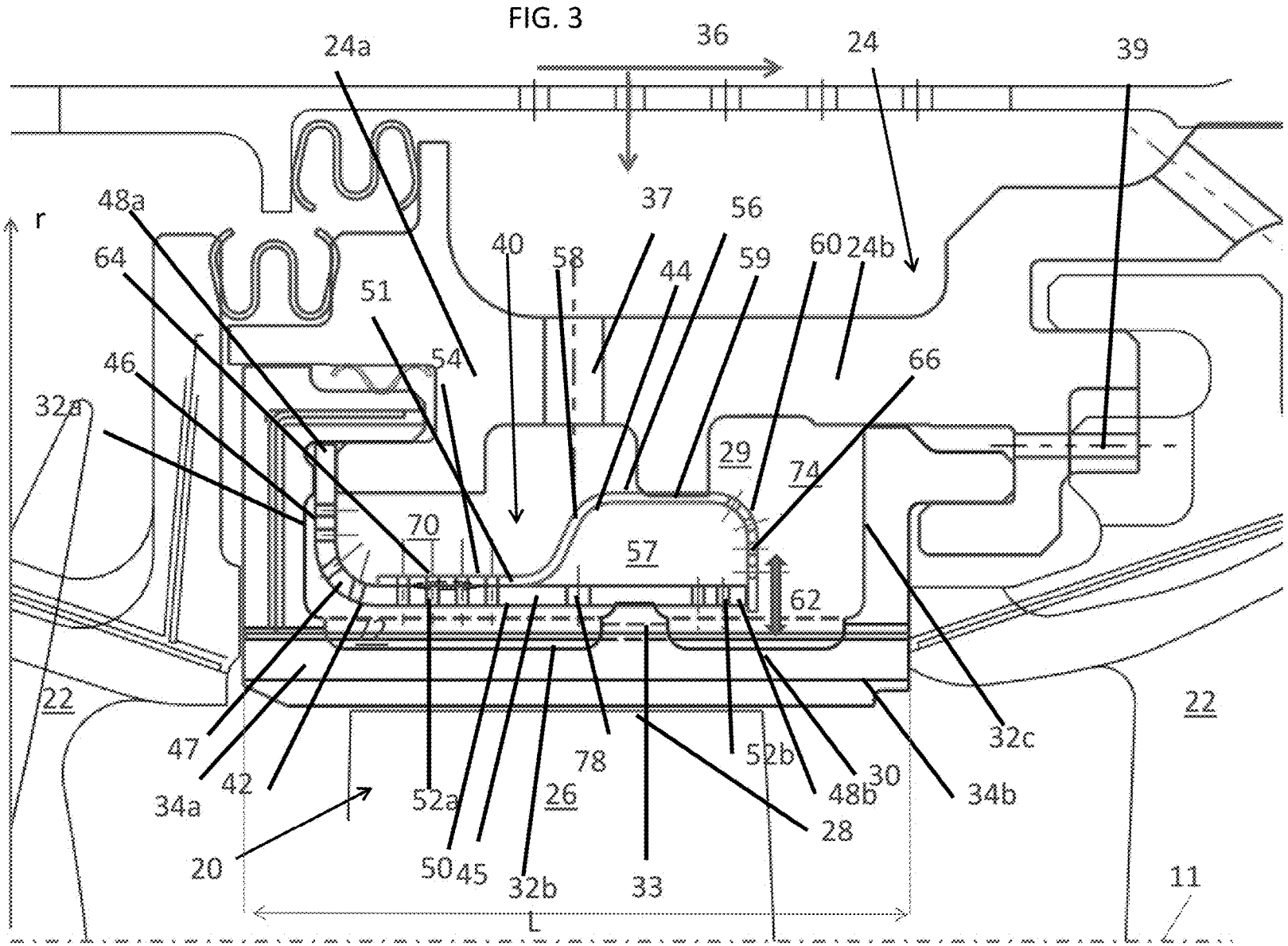
FIG. 3 is a cross-sectional view of a shroud of a turbine stator of the gas turbine engine of FIG. 1 shown with a cooling ring according to one embodiment.

Turning to FIGS. 2 and 3, the high pressure turbine 18*a* of the turbine section 18 includes a plurality of rotors 20 (shown only partially in FIG. 3) for rotation about the centerline 11 of the engine 10, and a plurality of stators 22 disposed between the plurality of rotors 20 in an alternating fashion. A turbine casing 24 surrounds each of the rotors 20 and supports the stators 22. The centerline 11 depicts an axial direction and a radial direction which will be used herein to describe positions of elements relative to one another Each rotor 20 includes a plurality of blades 26 extending radially from a hub (not shown) of the rotor 20. Each of the blades 26 includes a tip 28 at a radially outer end thereof. The tip 28 is spaced radially from an annular shroud 30 which is fixed to the turbine casing 24. The shroud 30 and casing 24 define an annular cavity 29 therebetween. As best seen in FIG. 3, the annular shroud 30 is an assembly of arcuate shroud segments 31 (only three being shown), each covering an angular portion of the annular shroud 30. The shroud segments 31 are connected with each other by the turbine casing 24 which runs around the rotor 20 in a ring-shaped manner. The shroud 30 is generally U-shaped with a proximal radial inner wall 32*a*, an axial inner wall 32*b*, and a distal radial inner wall 32*c*. The axial inner wall 32*b* may include a circumferential rib 33. The circumferential rib 33 may define a proximal portion 34*a* of the shroud 30 disposed upstream of the rib 33 and a distal portion 34*b* of the shroud 30 disposed downstream of the rib 33. Because the proximal portion 34*a* is positioned closer to the exhaust gases of the combustor 16 than the distal portion 34*b*, the proximal portion 34*a* is subject to higher temperatures and higher temperature changes than the distal portion 34*b*.

Parts of the high pressure turbine 18*a* may be cooled using relatively cool air coming from a core flow 36 (shown in FIG. 1) of air which hasn't been fed to the combustor 16. Some of the core flow 36 air may be directed to the shroud 30 via an inlet 37 before exiting the cavity 29 through an outlet 39. In one embodiment, the inlet 37 and outlet 39 are a plurality of apertures formed in the casing 24.

A cooling ring assembly 40, disposed in the cavity 29, redirects air taken from the core flow 36 to portions of the shroud 30 in a sequential manner, to favour, for example, cooling of the hotter proximal portion 34*a* of the shroud 30 over the distal portion 34*b*. The cooling ring assembly 40 will be described as part of the shroud 30 of the turbine casing 24 of one of the rotors 20 of the gas turbine engine 10. It is contemplated, however, that the cooling ring assembly 40 could be adapted to other parts of the gas turbine engine 10. For example, the cooling ring assembly 40 could be part of the low pressure turbine 18*b*, or of the compressor section 14, or part of a stator, such as stator 22.

The cooling ring assembly 40 is an annular piece sandwiched between the shroud 30 and the turbine casing 24 shaped to partition a space formed therebetween.

The cooling ring assembly 40 includes an impingement body 42 and a dividing body 44. The impingement body 42 includes a flat axial portion 45 disposed close to the axial inner wall 32*b* of the shroud 30, and a flat radial portion 46 disposed close to the proximal radial inner wall 32*a*. The flat axial portion 45 and the flat radial portion 46 are connected to each other by a curved portion 47. A proximal end 48*a* of the impingement body 42 is held in position through abutment between the casing 24 and the shroud 30. A distal end 48*b* of the impingement body 42 at the flat axial portion 45 is free. The flat axial portion 45 rests on the rib 33. It is contemplated that the flat radial portion 46 could be omitted. It is also contemplated that the impingement body 42 could be secured to the casing 24 instead of being held in abutment. For example, the impingement body 42 could be welded to one of the casing 24 or any other mechanical attachment could be used.

The impingement body 42 has a first surface 50 facing the shroud 30, and a second surface 51 facing the casing 24. The impingement body 42 includes a plurality of proximal impingement apertures 52*a* formed through the impingement body 42 and facing the proximal portion 34*a* of the shroud 30. The proximal impingement apertures 52*a* are formed in a proximal part of the flat axial portion 45, and in the flat radial portion 46, and are distributed globally on a L-shaped curved portion of the impingement body 42. It is contemplated that the proximal impingement apertures 52*a* could be formed only in the proximal part of the flat axial portion 45, or only in the flat radial portion 46. The proximal impingement apertures 52*a* distribute the cooling air to the proximal portion 34*a* of the shroud 30. The impingement body 42 includes a plurality of distal impingement apertures 52*b* formed through the impingement body 42 and facing the distal portion 34*b* of the shroud 30. The distal impingement apertures 52*b* are formed in a distal part of the flat axial portion 45. The distal impingement apertures 52*b* distribute the cooling air to the distal portion 34*b* of the shroud 30.

The dividing body 44 is connected to the second surface 51 of the impingement body 42. The dividing body 44 includes a flat portion 54 secured to the proximal part of the axial portion 45 of the impingement body 42, and an inverted U-shaped portion 56 forming with the distal part of the axial portion 45 an intermediate annular chamber 57. The inverted U-shaped portion 56 includes a proximal radial branch 58, an axial branch 59, and a distal radial branch 60. The proximal radial branch 58 is a non-diffusive wall which directs the coolant coming from the inlet 37 to the proximal portion 34*a* of the shroud 30. The axial branch 59 buts the casing 24. The distal radial branch 60 is not directly connected to the impingement body 42 and is free to move relative to it radially, as indicated by arrow 62. The abutment of the cooling ring assembly 40 between the casing 24 and the shroud 30 provides a spring effect which secures the cooling ring assembly 40 inside the cavity 29.

The flat portion 54 of the dividing body 44 includes a plurality of apertures 64 which coincides with the impingement apertures 52*a* on the flat axial portion 45 of the impingement body 42. The distal radial branch 60 of the dividing body 44 includes a plurality of apertures 66. It is contemplated that the flat portion 54 of the dividing body 44 could be shorter than shown in the Figures such that it would not coincide with the impingement apertures 52*a* on the flat axial portion 45 of the impingement body 42 and would not have the apertures 66. Although in the present embodiment the flat portion 54 of the dividing body 44 is welded to the flat axial portion 45 of the impingement body 42, it is contemplated that the impingement body 42 and the dividing body 44 could be connected to each other by other means. For example, the impingement body 42 could be bolted to the dividing body 44, the impingement body 42 and the dividing body 44 could be casted or Metal Injection Molded or even machined. The impingement body 42 and the dividing body 44 are both formed of sheet metal, but other materials resisting to the temperatures and vibrations involved in gas turbine engines, such as the gas turbine engine 10, could be used. For example, the impingement body 42 and the dividing body 44 could be made of ceramic. The impingement body 42 and the dividing body 44 may be both unitary made, i.e. there are made of a single piece of material, or an integral piece of components. In one embodiment, the cooling ring assembly 40 is a monolithic piece in circumference. However, the cooling ring assembly 40 could be made of several segments, similarly to the shroud 30. The cooling ring assembly 40 could be, for example, made of two half rings, or four quarter rings connected to each other end-to-end. The circumferential unitary formation of the cooling ring assembly 40 may provide a more efficient cooling than a non-unitary construction.

The cooling ring assembly 40, when disposed in the cavity 29 defines a plurality of annular chambers constraining the cooling air in certain areas of the space formed between the shroud 30 and the turbine casing 24 so that the cooling air circulates between these areas in a predefined sequential manner, thereby cooling the shroud 30 in a sequential manner.

A first annular chamber 70 is defined by a proximal portion 24*a* of the turbine case 24, the flat radial portion 46 and the curved portion 47 of the impingement body 42 (i.e. second surface 51), the proximal part of the flat axial portion 45/the flat portion 54 of the dividing body 44 and the proximal radial branch 58 of the inverted U-shaped portion 56 of the dividing body 44. The proximal radial branch 58 is disposed toward a middle of the shroud's 30 axial length L so as to force the cooling air toward the proximal portion 34*a* of the shroud 30. The proximal radial branch 58 acts as a divider between the proximal portion 24*a* of the turbine case 24 and a distal portion 24*b* of the turbine case 24. It contemplated that a wall other than the proximal radial branch 58 could act as a divider between the proximal portion 24*a* and the distal portion 24*b* of the turbine case 24. For example, should the dividing body 44 not abut the casing 24, a seal, placed between the dividing body 44 and the casing 24, would act as a divider.

The proximal impingement apertures 52*a* are disposed at proximity of the proximal portion 34*a* of the shroud 30 so as to impinge onto the proximal radial inner wall 32*a* and a proximal part of the axial inner wall 32*b*. The pressure of the cooling air accumulating in the first annular chamber 70 forces the cooling air out of the first annular chamber 70 through the impingement apertures 52*a* to the second annular chamber 72 in a jet like manner, furthering the cooling effect onto the proximal portion 34*a* of the shroud 30. Should the impingement body 42 not have the radial portion 46, the proximal radial inner wall 32*a* of the shroud 30 would not be impinged by the cooling air.

The second annular chamber 72 is defined by the proximal radial inner wall 32*a* of the shroud 30, a proximal part of the axial inner wall 32*b* of the shroud 30, the curved portion 47 and a proximal part of the flat axial portion 45 of the impingement body 42 (i.e. first surface 50), and the rib 33 of the shroud 30.

The intermediate annular chamber 57 is defined by a distal part of the flat axial portion 45 of the impingement body 42 including the distal impingement apertures 52*b* and by the inverted U-shaped portion 56 of the dividing body 44. One or more intermediate apertures 78 in the flat axial portion 45 communicate from the second annular chamber 72 to the intermediate annular chamber 57. The intermediate apertures 78 are disposed downstream of the proximal impingement apertures 52*a* and upstream of the rib 33 and the distal impingement apertures 52*b*. The distal impingement apertures 52*b* in the impingement body 42 and the apertures 66 in the distal radial branch of the dividing body 44 communicate the cooling air from the intermediate annular chamber 57 to the fourth annular chamber 74. The distal impingement apertures 52*b* inject air onto a distal part of the axial inner wall 32*b* of the shroud 30, while the apertures 66 inject air onto the distal radial inner wall 32*c* of the shroud 30.

The fourth annular chamber 74 is sized to enable assembling of the cooling ring assembly 40 with the shroud 30 and the turbine casing 24. Outlet 39 in the turbine casing 24 evacuate the cooled air from the fourth annular chamber 74 to an adjacent stator 22.

Figure 4:
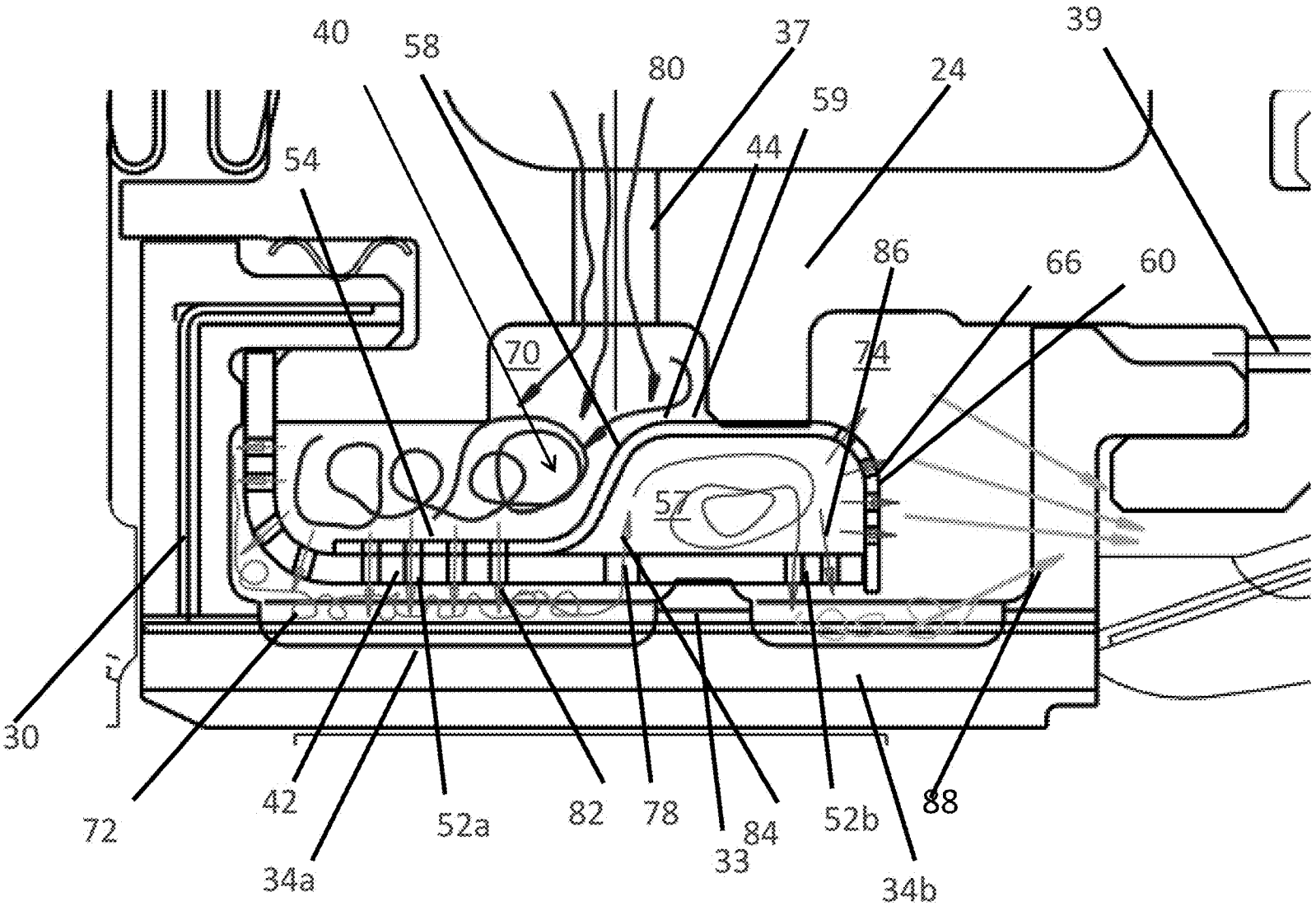
FIG. 4 is the cross-sectional view of FIG. 3 shown with arrows indicating a cooling sequence through the cooling ring.

Turning now to FIG. 4, a flow path of the coolant in the cavity 29 so as to sequentially cool the shroud 30 will be described.

As illustrated by arrows 80, cooling air from the core flow 36 enters the first annular chamber 70 via the inlet 37 in the turbine casing 24. The first annular chamber 70 forms a plenum where cooling air is pressurised. A control of the pressurisation of the first annular chamber 70 is achieved by the size and number of the proximal impingement apertures 52*a*. The smaller and less numerous the impingement apertures 52*a*, the higher the pressure in the first annular chamber 70. Coolant air escapes the first annular chamber 70 through the proximal impingement apertures 52*a* toward the second annular chamber 72 in a jet-like manner, as indicated by arrows 82. The presence of the dividing body 44 ensures that the cooling air incoming the inlet 37 goes to the proximate portion 32*a* of the shroud 30 exclusively before reaching the distal portion 32*a*, and only after having cooled the proximate portion 32*a* of the shroud 30.

The second annular chamber 72 is also pressurised at a pressure less than that of the first annular chamber 70 to enable unidirectional flow from the first annular chamber 70 to the second annular chamber 72. Once the cooling air has cooled the proximal portion 34*a* of the shroud 30, the cooling air exists the second annular chamber 72 toward the intermediate annular chamber 57 via the intermediate apertures 78. A number and size of the intermediate apertures 78 may be smaller than that of the impingement apertures 52*a* so that the cooling air has tendency to accumulate in the second annular chamber 72 for cooling the proximal portion 34*a* of the shroud 30 instead of leaving the second annular chamber 72 toward the intermediate annular chamber 57. The number and size of the intermediate apertures 78 enables the second annular chamber 72 to have a pressure higher than that of the intermediate annular chamber 57 to enable unidirectional flow from the second annular chamber 72 to the intermediate annular chamber 57, as indicated by arrow 84. The plurality of impingement apertures 52*a* define an inlet area to the second annular chamber 72, and the intermediate apertures 78 define an outlet area to second annular chamber 72. The outlet area is smaller than the inlet area so as to pressurise the second annular chamber 72. All the cooling air (expect leaking between the shroud segments 31) contained in the second annular chamber 72 is redirected to the intermediate annular chamber 57.

The intermediate annular chamber 57 allows to redirect the cooling air toward the distal portion 34*b* of the shroud 30, after the proximal portion 34*a* of the shroud 30 has been cooled by all the available cooling air that entered the cavity 29. The cooling air accumulated in the intermediate annular chamber 57 escapes via the distal impingement apertures 52*b* and the apertures 66 which are disposed facing the distal portion 34*b* of the shroud 30. The distal impingement apertures 52*b* and the exit apertures 66 communicate only with the fourth annular chamber 74 so that all the cooling air contained in the intermediate annular chamber 57 is redirected to the fourth annular chamber 74. The number and size of the distal impingement apertures 52*b* and the exit apertures 66 enables the intermediate annular chamber 57 to have a pressure higher than that of the fourth annular chamber 74 to enable unidirectional flow from the intermediate annular chamber 57 to the fourth annular chamber 74, as indicated by arrow 86. All the cooling air contained in the intermediate annular chamber 57 is redirected to the fourth annular chamber 74 in a jet-like manner. The cooling air in the fourth annular chamber 74 cools the distal portion 34*b* of the shroud 30 before exiting via the outlet 39 in the turbine casing 24 toward the stator 22. Arrow 88 indicates several natural paths of the exiting cooling air.

According to the above, the cooling in the shroud 30 is done sequentially, through the annular chambers 70, 72, 58 and 74 which are entered by the cooling air in a series fashion. As a result, air cooling is optimised and controlled. A better cooling may improve the durability of the shroud segments 31. This arrangement may also reduce the amount of cooling air needed to cool the shroud 30. The proximity of the impingement body 42 to the shroud 30 and the impingement of the coolant air onto the the shroud 30 in a jet-like manner allows relatively efficient cooling of the shroud 30. The geometry of the cooling ring assembly 40 allows all the cooling air entering the cavity 29 to be directed to the proximal portion 34*a* of the shroud 30. Because the cooling ring assembly 40 in a monolithic annular piece, there is minimal leak of cooling air.

To assemble the cooling ring assembly 40 with the shroud 30 and the turbine casing 24, the user first obtains the cooling ring assembly 40. The user then positions the shroud segments 31 onto the cooling ring assembly 40 such that the shroud segments 31 are disposed radially inwardly relative to the cooling ring assembly 40. The proximal end 48*a* of the impingement body 42 abuts against a top portion of the proximal radial inner wall 32*a* of the shroud 30, while the flat axial portion 45 of the impingement body 42 rests on the rib 33 of the shroud 30. The shroud segments 31 may be connected to each other by bolts for example, but are generally free to move independently from one another. Once the shroud 30 and the cooling ring assembly 40 are assembled, the cooling ring assembly 40 is disposed into the turbine casing 24. The proximal end 48*a* of the impingement body 42 becomes sandwiched by the proximal radial inner wall 32*a* of the shroud 30 and the turbine casing 24. The axial branch 59 of the inverted U-shaped portion 56 abuts then the turbine casing 24 and that portion of the cooling ring assembly 40 becomes compressed in abutment between the turbine casing 24 and the shroud 30. The sandwiching of that portion of the cooling ring assembly 40 provide a spring effect, since the inverted U-shaped portion 56 is not directly connected to the impingement body 42. The spring effect allows to seal the different annular chambers, in a manner that may be efficient, easy and would not require additional components to connect the ring 40, shroud 30 and turbine case 24 together.

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

The invention claimed is:

1. A gas turbine engine comprising:

an annular shroud encircling one of a stator and a rotor, the shroud having a first portion and a second portion axially disposed relative to a rotation axis of the engine and a direction of airflow through the rotor in use;

an annular casing outwardly spaced-apart from the shroud and mounted thereto to define an annular cavity between the casing and the shroud, the cavity including an inlet communicating with a source of coolant air and an outlet communicating with a gas path;

an annular ring assembly disposed in the cavity between the casing and the shroud and configured to cooperate with the casing and the shroud, the annular ring assembly and the first portion of the shroud forming a first annular chamber, the annular ring assembly and the second portion of the shroud forming a second annular chamber, the annular ring assembly forming an intermediate annular chamber disposed between the first annular chamber and the second annular chamber, the annular ring assembly having:

a non-diffusive wall preventing coolant incoming from the inlet to reach the second portion of the shroud and directing the coolant toward the first annular chamber;

an annular impingement body having:

a first surface facing the shroud; and an opposed second surface facing the casing; and an annular dividing body connected to the second surface of the impingement body and forming therewith the intermediate annular chamber, the annular ring assembly having a plurality of first impingement apertures for distributing coolant from the inlet to the first portion of the shroud and a plurality of second impingement apertures for distributing coolant from the intermediate annular chamber to the second portion of the shroud, the first annular chamber communicating with the intermediate annular chamber via at least one intermediate aperture disposed between the plurality of first impingement apertures and the plurality of second impingement apertures, the annular ring assembly thus providing a coolant flow path sequentially from the inlet, through the first annular chamber, the intermediate annular chamber, the second annular chamber and the outlet, the annular ring assembly is secured in compression between the shroud and the casing.

2. The gas turbine engine of claim 1, wherein a first portion of the first surface of the impingement body forms with the first portion of the shroud the first annular chamber, a second portion of the first surface of the impingement body forms with the second portion of the shroud the second annular chamber, the first portion of the first surface of the impingement body includes the plurality of first impingement apertures, and the second portion of the first surface of the impingement body includes the plurality of second impingement apertures.

3. The gas turbine engine of claim 1, wherein the dividing body has one end fixedly connected to the second surface of the impingement body, and one end radially displaceable relative to the impingement body.

4. The gas turbine engine of claim 1, wherein the shroud includes a circumferential rib defining a separation between the first and second annular chambers.

5. The gas turbine engine of claim 1, wherein the shroud includes a plurality of shroud segments, the annular ring assembly extending through the plurality of shroud segments.

6. The gas turbine engine of claim 1, wherein the plurality of first impingement apertures are distributed onto a curved L-shaped portion of the impingement body.

7. The gas turbine engine of claim 1, wherein the dividing body includes the non-diffusive wall.

8. The gas turbine engine of claim 7, wherein the dividing body has an inverted U-shaped portion including a first radial branch, an axial branch, and a second radial branch, the first radial branch defining the non-diffusive wall, the second radial branch including a plurality of apertures.

9. The gas turbine engine of claim 1, wherein the impingement body is monolithic.

10. The gas turbine engine of claim 1, wherein the dividing body is monolithic.

11. The gas turbine engine of claim 1, wherein the plurality of first impingement apertures define an inlet area to the first annular chamber, and the at least one intermediate aperture defines an outlet area of the first annular chamber, the outlet area being smaller than the inlet area.

12. A gas turbine engine comprising:

an annular casing;

a plurality of shroud segments forming an annular shroud, each shroud segment defining an angular portion of the annular shroud, the annular shroud forming with the annular casing an annular cavity therebetween, the annular cavity including an inlet and an outlet; and an annular ring assembly disposed in the annular cavity between the annular casing and the annular shroud and cooperating therewith to provide a first annular chamber and a second annular chamber, the annular ring assembly and a first portion of the annular shroud forming the first annular chamber, the annular ring assembly and a second portion of the annular shroud forming the second annular chamber, the annular ring assembly forming an intermediate annular chamber disposed between the first annular chamber and the second annular chamber, a flow path for coolant air being sequentially defined through the inlet, the first annular chamber, the intermediate annular chamber, the second annular chamber and the outlet;

wherein the annular ring assembly is secured in compression between the annular shroud and the annular casing.

13. The gas turbine engine of claim 12, wherein the annular ring assembly includes:

a plurality of first impingement apertures distributing coolant from the inlet to the first portion of the annular shroud; and a plurality of second impingement apertures distributing coolant from the intermediate annular chamber to the second portion of the annular shroud; and at least one intermediate aperture disposed axially between the pluralities of first and second impingement apertures, the first annular chamber fluidly communicating with the intermediate annular chamber via the at least one intermediate aperture.

14. The gas turbine engine of claim 13, wherein the plurality of first impingement apertures define an inlet area to the first annular chamber, and the at least one intermediate aperture defines an outlet area of the first annular chamber, the outlet area being smaller than the inlet area.

15. The gas turbine engine of claim 12, wherein the annular ring assembly includes an annular impingement body having a flat axial portion, the flat axial portion having a first surface facing the annular shroud and an opposed second surface facing the annular casing; and an annular dividing body connected to the second surface of the annular impingement body, the annular dividing body including a U-shaped portion, the U-shaped portion and the second surface of the flat axial portion of the annular impingement body forming the intermediate annular chamber.

16. The gas turbine engine of claim 15, wherein the annular dividing body has one end fixedly connected to the second surface of the annular impingement body, and one end radially displaceable relative to the annular impingement body.

17. The gas turbine engine of claim 12, wherein the annular ring assembly includes an annular impingement body having a flat axial portion, the flat axial portion having a first surface facing the annular shroud and an opposed second surface facing the annular casing; and an annular dividing body connected to the second surface of the annular impingement body, the annular dividing body being monolithic.

18. The gas turbine engine of claim 12, wherein the annular ring assembly includes an annular impingement body having a flat axial portion, the flat axial portion having a first surface facing the annular shroud and an opposed second surface facing the annular casing; and wherein the first surface of the annular impingement body forms with the first portion of the annular shroud the first annular chamber, and the first surface of the annular impingement body forms with the second portion of the annular shroud the second annular chamber.

19. A gas turbine engine comprising:

an annular shroud encircling one of a stator and a rotor, the shroud having a first portion and a second portion axially disposed relative to a rotation axis of the engine and a direction of airflow through the rotor in use;

an annular casing outwardly spaced-apart from the shroud and mounted thereto to define an annular cavity between the casing and the shroud, the cavity including an inlet communicating with a source of coolant air and an outlet communicating with a gas path;

an annular ring assembly disposed in the cavity between the casing and the shroud and configured to cooperate with the casing and the shroud, the annular ring assembly and the first portion of the shroud forming a first annular chamber, the annular ring assembly and the second portion of the shroud forming a second annular chamber, the annular ring assembly forming an intermediate annular chamber disposed between the first annular chamber and the second annular chamber, the annular ring assembly having:

a non-diffusive wall preventing coolant incoming from the inlet to reach the second portion of the shroud and directing the coolant toward the first annular chamber;

an annular impingement body having:

a first surface facing the shroud; and an opposed second surface facing the casing; and an annular dividing body connected to the second surface of the impingement body and forming therewith the intermediate annular chamber, the annular ring assembly having a plurality of first impingement apertures for distributing coolant from the inlet to the first portion of the shroud and a plurality of second impingement apertures for distributing coolant from the intermediate annular chamber to the second portion of the shroud, the first annular chamber communicating with the intermediate annular chamber via at least one intermediate aperture disposed between the plurality of first impingement apertures and the plurality of second impingement apertures, the annular ring assembly thus providing a coolant flow path sequentially from the inlet, through the first annular chamber, the intermediate annular chamber, the second annular chamber and the outlet;

wherein the dividing body has one end fixedly connected to the second surface of the impingement body, and one end radially displaceable relative to the impingement body.

20. A gas turbine engine comprising:

an annular shroud encircling one of a stator and a rotor, the shroud having a first portion and a second portion axially disposed relative to a rotation axis of the engine and a direction of airflow through the rotor in use;

an annular casing outwardly spaced-apart from the shroud and mounted thereto to define an annular cavity between the casing and the shroud, the cavity including an inlet communicating with a source of coolant air and an outlet communicating with a gas path;

an annular ring assembly disposed in the cavity between the casing and the shroud and configured to cooperate with the casing and the shroud, the annular ring assembly and the first portion of the shroud forming a first annular chamber, the annular ring assembly and the second portion of the shroud forming a second annular chamber, the annular ring assembly forming an intermediate annular chamber disposed between the first annular chamber and the second annular chamber, the annular ring assembly having:

a non-diffusive wall preventing coolant incoming from the inlet to reach the second portion of the shroud and directing the coolant toward the first annular chamber;

an annular impingement body having:

a first surface facing the shroud; and an opposed second surface facing the casing; and an annular dividing body connected to the second surface of the impingement body and forming therewith the intermediate annular chamber, the annular ring assembly having a plurality of first impingement apertures for distributing coolant from the inlet to the first portion of the shroud and a plurality of second impingement apertures for distributing coolant from the intermediate annular chamber to the second portion of the shroud, the first annular chamber communicating with the intermediate annular chamber via at least one intermediate aperture disposed between the plurality of first impingement apertures and the plurality of second impingement apertures, the annular ring assembly thus providing a coolant flow path sequentially from the inlet, through the first annular chamber, the intermediate annular chamber, the second annular chamber and the outlet, wherein the dividing body includes the non-diffusive wall, the dividing body having an inverted U-shaped portion including a first radial branch, an axial branch, and a second radial branch, the first radial branch defining the non-diffusive wall, the second radial branch including a plurality of apertures.

* * * * *